US009161643B2

(12) United States Patent
Prokop, III et al.

(10) Patent No.: US 9,161,643 B2
(45) Date of Patent: Oct. 20, 2015

(54) IMPLEMENT WITH A HANDLE FOR A USER HAVING AN IMPAIRED HAND GRIP

(71) Applicants: Frank James Prokop, III, Woodstock, GA (US); J. Robert Snypp, III, Dunwoody, GA (US); Ronald Cleveland Barbas, Roswell, GA (US); Kevin M. Johnston, Cumming, GA (US)

(72) Inventors: Frank James Prokop, III, Woodstock, GA (US); J. Robert Snypp, III, Dunwoody, GA (US); Ronald Cleveland Barbas, Roswell, GA (US); Kevin M. Johnston, Cumming, GA (US)

( * ) Notice: Subject to any disclaimer, the term of this patent is extended or adjusted under 35 U.S.C. 154(b) by 42 days.

(21) Appl. No.: 13/922,213

(22) Filed: Jun. 19, 2013

(65) Prior Publication Data

US 2014/0373862 A1 Dec. 25, 2014

(51) Int. Cl.

| | |
|---|---|
| ***A45D 24/00*** | (2006.01) |
| ***A45D 7/02*** | (2006.01) |
| ***A47G 21/08*** | (2006.01) |
| ***A47G 21/02*** | (2006.01) |
| ***A46B 5/02*** | (2006.01) |
| ***B26B 1/10*** | (2006.01) |
| ***A45D 24/14*** | (2006.01) |

(52) U.S. Cl.

CPC ..... *A47G 21/08* (2013.01); *A45D 24/14* (2013.01); *A46B 5/025* (2013.01); *A47G 21/02* (2013.01); *B26B 1/10* (2013.01); *A45D 24/00* (2013.01); *A46B 2200/104* (2013.01); *A46B 2200/1066* (2013.01); *Y10T 16/476* (2015.01)

(58) Field of Classification Search

CPC ..... A45D 24/14; A45D 24/00; B26B 1/10; A47G 21/08; A47G 21/04; A47G 21/02; A46B 5/025; A46B 5/026; A46B 5/028; A46B 5/02; A46B 5/021; A46B 5/023; A46B 2200/104; A46B 2200/1066; A46B 2200/1086; A46B 2200/1093; Y10T 16/476

USPC ..... 132/150, 212, 213, 213.1, 219, 120, 132/148, 149, 320, 333; 30/123, 137, 129, 30/147–150, 322, 324, 327, 142, 323, 30/122; 16/419, 420, 430, 444, 446; 401/6–8; 15/167.3, 229.13, 143.1; D7/648, 394

See application file for complete search history.

(56) References Cited

U.S. PATENT DOCUMENTS

| | | | | | |
|---|---|---|---|---|---|
| 1,465,455 | A * | 8/1923 | Spraker | 132/142 |
| 2,010,074 | A * | 8/1935 | Fuerst | 30/150 |
| 2,150,260 | A * | 3/1939 | Yates | 132/149 |
| D132,441 | S * | 5/1942 | Graves | D7/648 |
| 2,496,062 | A * | 1/1950 | Morfesi | 7/112 |
| D161,359 | S * | 12/1950 | Milne | D7/648 |
| 4,974,286 | A * | 12/1990 | Stowell et al. | 16/421 |
| 5,373,643 | A * | 12/1994 | Warren | 30/322 |
| 5,479,708 | A * | 1/1996 | Thomas | 30/122 |
| 5,606,772 | A * | 3/1997 | Ilic | 16/421 |
| 5,623,739 | A * | 4/1997 | Thompson | 15/167.1 |
| 6,009,600 | A * | 1/2000 | Egeland et al. | 16/436 |
| 6,134,737 | A * | 10/2000 | Remme | 15/110 |
| 6,289,546 | B1 * | 9/2001 | Harada | 15/167.1 |
| 7,930,804 | B2 * | 4/2011 | Cornfield | 16/430 |
| 2008/0178471 | A1 * | 7/2008 | Rosario-Solis et al. | 30/122 |
| 2009/0144921 | A1 * | 6/2009 | Newsome | 15/143.1 |
| 2010/0325896 | A1 * | 12/2010 | Hebebrand | 30/150 |

* cited by examiner

*Primary Examiner* — Vanitha Elgart

(57) ABSTRACT

Provided is an implement that has a handle adapted to be positioned on a user's hand such that the user's hand goes through the handle. The handle has an aperture that is adapted to accept a user's hand. The implement of the present invention may have a wide variety of implements as described herein. Particular implements include, for example, personal care implements such as, eating utensils, a toothbrush or a hair care implement, such as, a hairbrush or comb.

19 Claims, 5 Drawing Sheets

IMPLEMENT WITH A HANDLE FOR A USER HAVING AN IMPAIRED HAND GRIP

FIELD OF INVENTION

The present invention relates to a handle designed to enable a person with a hand that is impaired from gripping to be able to use an implement, such as implements commonly found in the home. More particularly, the present invention relates to a handle for a personal care implement.

BACKGROUND OF THE INVENTION

There are many conditions or injuries to the hand that can make it difficult, if not impossible, for a person to grip a personal care implement, such as eating utensils, a toothbrush, and hair maintenance implements such as brushes and combs. For example, a user may be impaired by medical conditions such as arthritis, a stroke, or may be impaired due to an injury such as a broken wrist, which requires the user to wear a cast or bone immobilizing apparatus until the bones have healed. Often a cast on the forearm of a user covers the wrist and will typically go around the user's area of the hand between the index finger and thumb, making it difficult to grip items. No matter what the situation is, it can be nearly impossible for a person having one or more of these or similar conditions to grab and hold a personal care implement, which makes it difficult for a person who has an impaired gripping function to effectively take care of themselves, or their surroundings.

Other implements have been suggested in the art having looped handles. Each of the prior art implements has one or more drawbacks. For example, U.S. Pat. No. 5,373,643 suggests an eating implement for a person having difficulty in gripping conventional eating implements. However, the design taught in this patent lacks proper stability that is provided by a user's thumb. As a result, the eating utensil suggested by this patent can rotate on the user's hand, making it difficult for the user to control the eating utensil during use.

Accordingly, there is a need in the art to provide an implement having improved stability for a person having an impaired movement of the fingers of a hand that makes it difficult for the user grip the implement. The present invention provides an answer to that need.

SUMMARY OF THE INVENTION

In one aspect, the present invention provides an implement for use by a user having a hand which is impaired from gripping. The implement has a handle section, and utility head section. The handle section has a proximate end member, a distal end member, a upper member and a lower member, wherein the proximate end is connected to the distal end member by the upper member and the lower member, such that the upper member, the lower member, the distal end member and the proximate end member form an aperture within the handle between the combination of the distal end, proximate end, upper and lower members. This aperture is adapted to receive the hand of a user. A utility head is attached to the handle section at the proximate end member and is attached to the proximate end member on a side of the proximate end member that is opposite the aperture of the handle section. The personal care implement further has at least one projection member located on the proximate end member on a side of the proximate end member, which is opposite said aperture of the handle section. This projection member is located adjacent the area of contact of the handle section and the utility head section of the personal care implement.

In a further embodiment of the present invention, the handle section has two projection members, wherein one projection member is located below where the utility head section connects to the proximate end member of the handle, and a second projection member is located above where the utility head section connects to the proximate end member of the handle.

In a further aspect of the present invention, the utility head section is a personal care implement, such as a spoon, a fork, a spork, a knife, a toothbrush, a hair brush or a comb.

In an additional embodiment of the present invention, the handle section and the utility head section form a unitary structure.

In yet another embodiment, the implement of the present invention has a utility head section is connected to the handle such that a utility head of the utility head section is out of a vertical plane of the handle, where the vertical plane extends through each of the proximate end member, the distal end member, the top member and the bottom member.

In further embodiments of the present invention, the top member and the bottom member of the handle section are parallel to one another. Further, the proximate member and the distal member of the handle section are each curved; and optionally have a generally C-shape.

In an additional embodiment of the present invention, the utility head section has a utility head and a connection member, where the connection member has a first end and a second end, the first end being connected to an outer surface of the proximate end member. The connection member may be straight or curved.

These and other aspects will become apparent when reading the detailed description of the invention.

DETAILED DESCRIPTION

Figure 1:
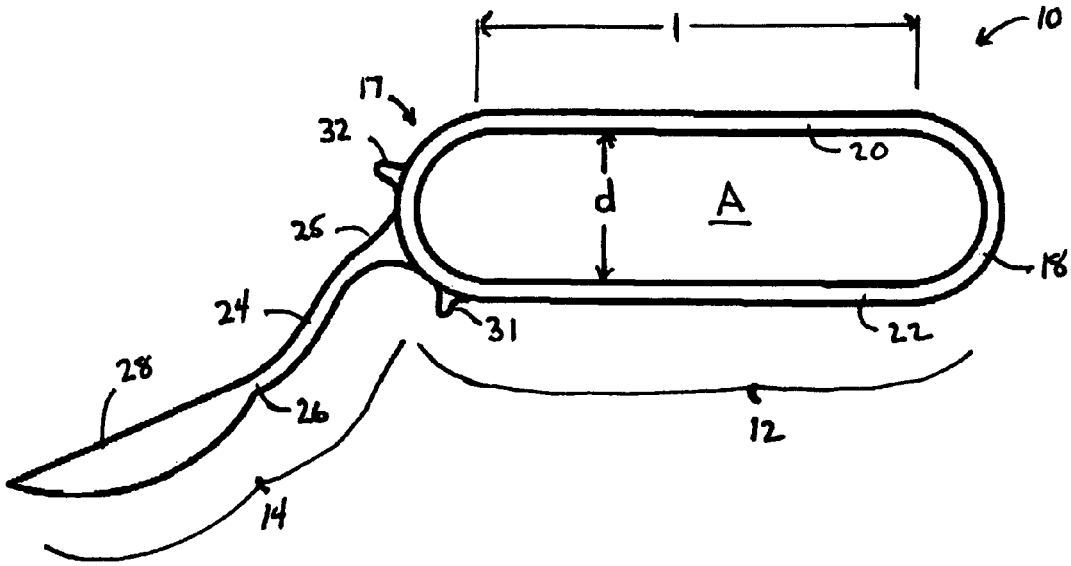
FIG. 1 shows a side view of the personal care implement of the present invention, where the utility head is a spoon.

In the following detailed description of the present invention, reference is made to the accompanying drawings which form a part hereof, and which shows by way of illustration, specific embodiments in which the invention may be practiced. These embodiments are described in sufficient detail to enable those skilled in the art to practice the invention, and it is to be understood that other embodiments may be utilized and that mechanical, procedural, and other changes may be made without departing from the spirit and scope of the present invention. The following detailed description is, therefore, not to be taken in a limiting sense, and the scope of the present invention is defined only by the appended claims, along with the full scope of equivalents to which such claims are entitled.

To gain a better understanding of the present invention, attention is directed to the Figures. It is noted that the terms "above" and "below" used herein are intended to be relative terms, as shown in the drawings and are not intended to be limiting.

Figure 2:
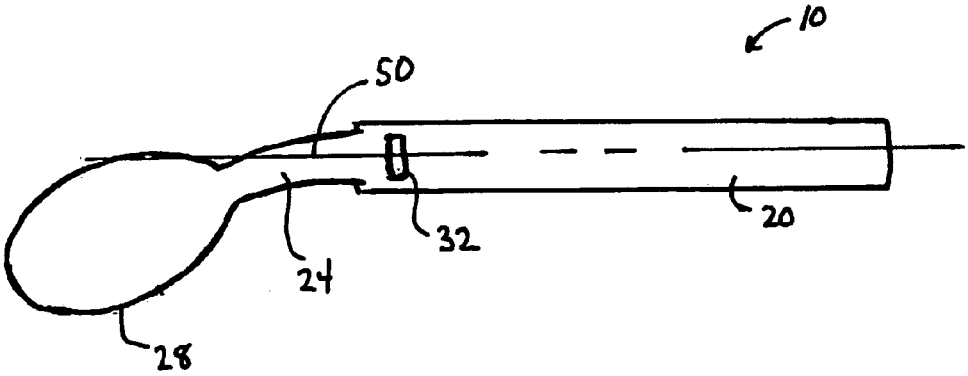
FIG. 2 shows a top view of the personal care implement of the present invention, where the utility head is a spoon.
Figure 3:
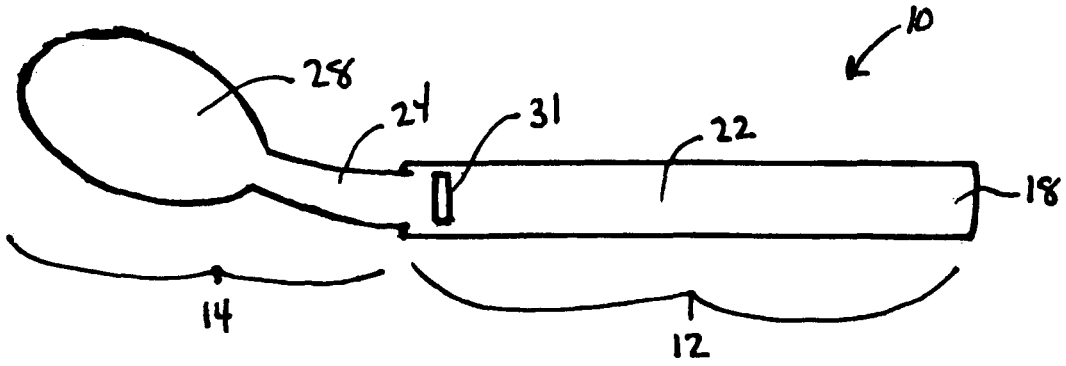
FIG. 3 shows a bottom view of the personal care implement of the present invention, where the utility head is a spoon.

Referring to FIGS. 1-3, shown is an implement 10 for use by a user having a hand which is impaired from gripping. The implement 10 has a handle section 12, and utility head section 14, in which the handle section 12 is connected to the utility head section 14. The handle section 12 has a proximate end member 16, a distal end member 18, an upper member 20 and a lower member 22, wherein the proximate end member 16 is connected to the distal end member 18 by the upper member 20 and the lower member 22, such that the upper member 20, the lower member 22, the distal end member 18 and the proximate end member 16 form an aperture A within the handle section 12. The aperture A is between the combination of the distal end member 18, proximate end member 16, upper and lower members 20, 22.

Figure 4:
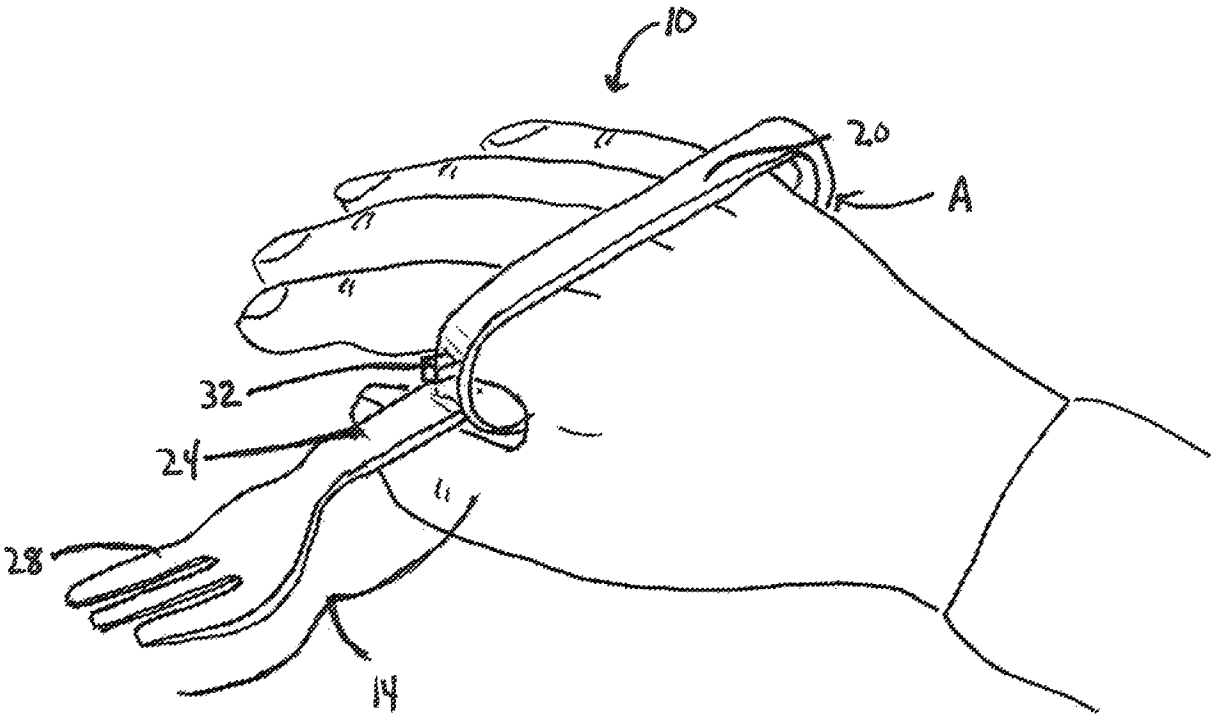
FIG. 4 shows a perspective view of the personal care implement of the present invention with a user's hand inserted into the aperture and a where the utility head is a fork.

The aperture A is adapted to receive the hand of a user. By "adapted to receive the hand of a user" it is intended that the size and shape of the aperture A is such that the fingers of a human hand will be able to pass through the aperture A, as is shown in FIG. 4. Generally, the aperture A will be sized and shaped to allow the knuckles of the user's hand to enter the aperture, such that the upper member will cover the knuckles of the user's hand or, in the alternative, will allow the knuckles of the user's hand to pass through the aperture A. Typically, the distance d between the upper and lower members 20, 22 of the handle section 12 will be between about 1 and 2 inches, more specifically between about 1.125 inches and about 1.5 inches. In a specific example, distance d is about 1.20 inches. In addition, the aperture A will have an opening length l that is between about 3 inches and about 4 inches. Typically, the length l will be between about 3.25 inches and about 3.75 inches. A specific example, length l is about 3.5 inches. It is believed that these dimensions will accommodate over 80% of the human hands in the world. It is noted the dimensions are merely exemplary and are not intended to be limiting. Distance d and length l can be greater than or less than the dimensions mentioned above to accommodate larger or smaller hands, or hands deformed from disease, such as arthritis, without departing from the scope of the present invention.

In one embodiment of the present invention, the top member 20 and the bottom member 22 are essentially parallel to one another. In a further embodiment of the present invention the proximate end member 16 and the distal end member 18 are each curved. Typically, the proximate end member 16 and the distal end member 18 will each have a generally C-shape, as is shown in the Figures. It is pointed out the aperture A could have more of a box shape, wherein the proximate end 16, the distal end 18 are parallel with each other and perpendicular to the upper member 20 and the lower member 22. However, the curved shape is typically used so that no sharp edges are created and the structure is more durable than a box structure due to less stress in the structure of the handle. Another advantage is the curved shape is that it is often more pleasing to the eye of the user.

A utility head section 14 is attached to the handle section 12 at the proximate end member 16. The utility head section 14 is attached to the proximate end member 16 on a side 17 of the proximate end member 16 which is opposite the aperture A of the handle section 12. Side 17 may be referred to as an outer surface of the handle section. The utility head section 14 has a connecting member 24 and a utility head 28. Connecting member 24 has a first end 25 and a second end 26, where the first end 25 is connected or attached to the handle section 12 at the proximate end member 16 on the outer surface or side 17. The second end 26 of the connecting member 24 is connected or attached to the utility head 28.

Figure 6:
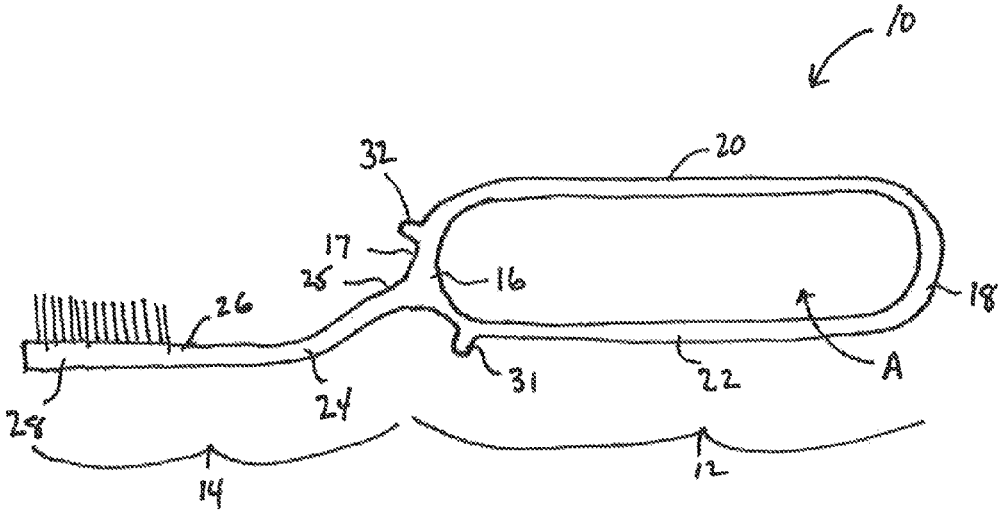
FIG. 6 shows a side view of the personal care implement of the present invention with the utility head is a toothbrush.
Figure 7:
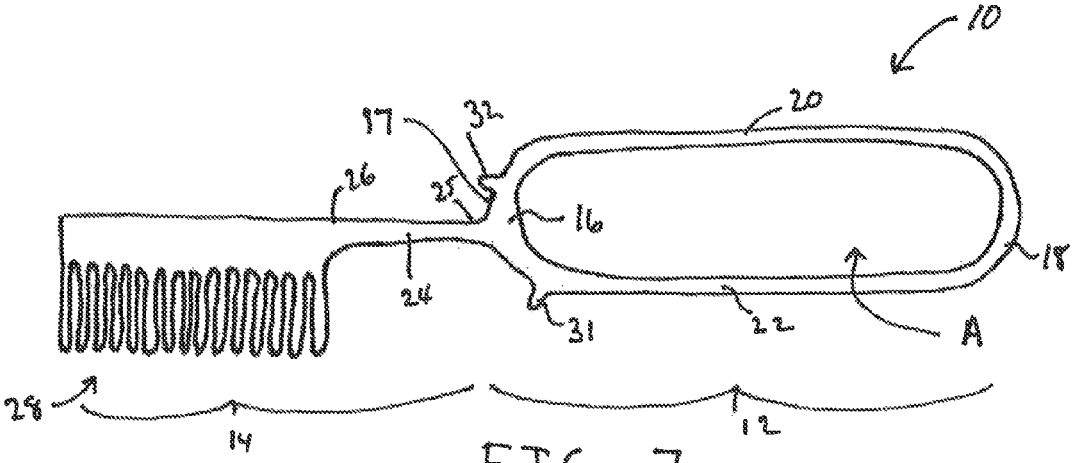
FIG. 7 shows a side view of the personal care implement of the present invention where the utility head is a comb.
Figure 8:
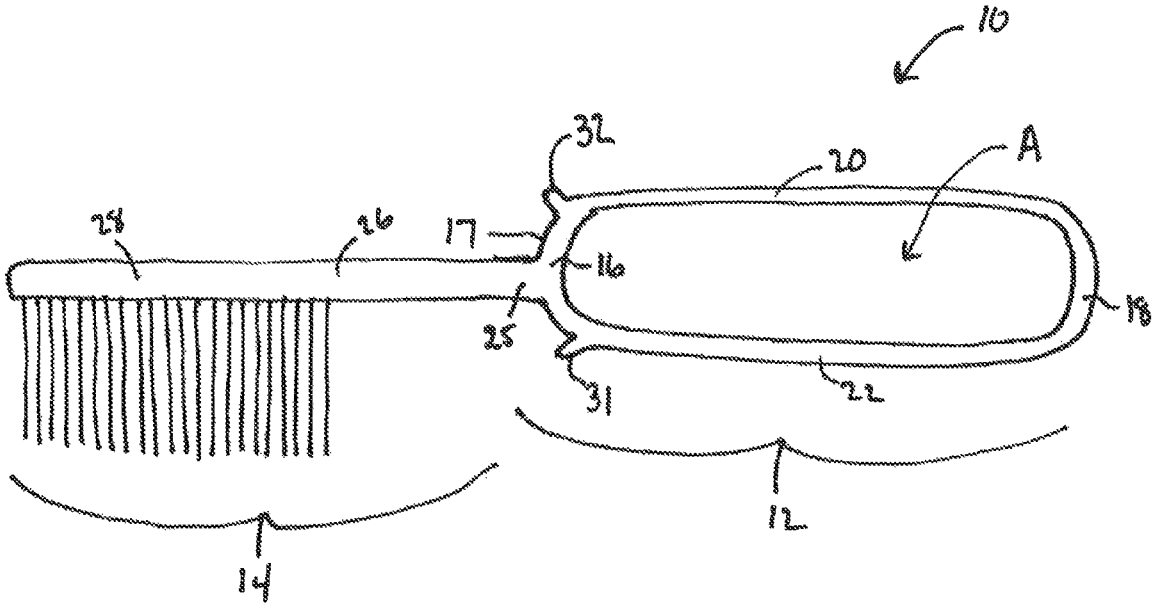
FIG. 8 shows a side view of the personal care implement of the present invention, where the utility head is a hairbrush.

The utility head section 14 may be a wide variety of implements. Implements contemplated by the present invention include personal care implement, kitchen utensils, such as cooking spoons, spatulas, pots, pans, measuring cups, measuring spoons, drinking cups and other similar kitchen utensils; household cleaning implements, such as dusters (including feather type and electrostatically charged nonwoven or fabric type materials), mops, brooms, cleaning brushes, and the like; small garden tools such as trowels, hand held cultivating forks and the like. In one particular embodiment of the present invention, the utility head section may be a personal care implement. Suitable utility heads 28 which will function as personal care implements include utility heads, for example, eating utensils, such as a spoon (shown in FIGS. 1-3), a fork (FIG. 4), a spork, which is a spoon like element with fork like prongs at the end (FIG. 5), a knife (not shown), oral hygiene heads such as a toothbrush (FIG. 6), or a hair care implement head, such as a comb (FIG. 7) or a hairbrush (FIG. 8).

The implement 10 further has at least one projection member 31 or 32 located on the proximate end member 16 on a side 17 of the proximate end member 16 which is opposite said aperture A of the handle section 12. This side 17 may also be considered the outer surface of the proximate end member 16. Projection member 31 is shown to be below the area of connection of the utility head section 14 to the handle section 12. Projection member 32 is shown to be above the area of connection of the utility head section 14 to the handle section 12. Both projection members 31 and 32 are shown in FIG. 1. It is noted that the personal care implement of the present invention may have a single projection member 31 or 32 or may have both projection members 31 and 32. Generally, the implement of the present invention will have both projection members, as is shown in FIG. 1, for the reasons discussed below.

The projection members 31 and/or 32 provide additional stability to the implement during use by the user. Each projection member 31 or 32 is adapted to allow a user's thumb to rest on the personal care implement. It is believed that by having the users thumb rest against one of the projection members 31 or 32, the personal care implement will be less likely to move on the user's hand during use. This is generally because during use, a user's thumb will be positioned between the projection member 31 or 32 and the connection member 24 of the utility head section. The projection member 31 or 32 prevents the user's thumb from slipping away from connection member 24 during use. While only one projection member is needed, typically both projection members 31 and 32 are provided, since some users will find it more comfortable to have the thumb positioned below the connection member 24, while other users will find it more comfortable to have their thumb positioned above the connection member 24. Therefore, providing both projection members makes personal care implement amenable to both groups of users. Further, for a utility head 28 which is a toothbrush, the user may have to rotate the personal care implement so that the toothbrush utility head will be in position to clean upper or lower teeth. Having both projection members 31, 32 will allow the user to have a similar feeling whether the utility head 28 is in an upward position or a downward position.

The projection members 31 and/or 32 are sized and shaped so that the user's thumb will easily rest against the projection member 31 or 32 during use. The projection members 31 and 32 may be blocks extending from the proximate end 16 of the handle section 12, or may have a curved shape to fit the users thumb. Generally, the projection members will extend from the proximate end a distance up to about ⅜ of an inch. Typically, the projection member will extend about 1/16 to about ¼ of an inch from the proximate end 16 of the handle section 12.

Turning to the utility head section 14, the utility head section 14 has a connection member 24 and a utility head 28. The connection member 24 serves as a spacer to move the utility head 28 away from the users hand a comfortable distance so the personal care implement is comfortable for the user to use. Typically the connection member is a length so utility head is up to about 3 inches away from the user's hand. The actual length of the connection member 24 will depend on the utility head 28. For eating utensils or a tooth brush, the connecting member will be longer so that the user will be able to insert the utility head into one's mouth without the user's hand contacting the mouth. In contrast, the connection member for a hair care implement will be shorter, so that the user's hand will be adjacent the area of the user's hair being groomed. In such a case, the connection member 24 can be as short as about ¼ of an inch.

Figure 5:
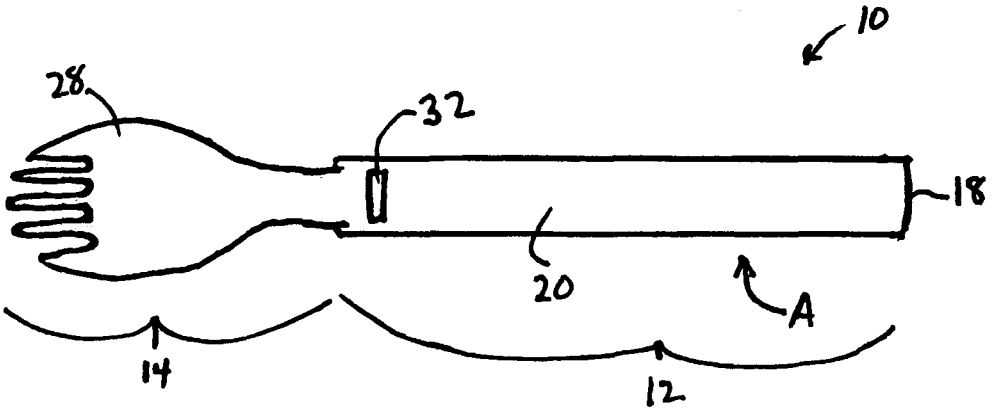
FIG. 5 shows a top view of the personal care implement of the present invention where the utility head is a spork.

The connection member 24 may be straight, as shown in FIG. 4 or may be curved, as is shown in FIG. 2. In addition, the connection member may be curved such that the utility head is out of a vertical plane 50 of the handle section 12, where the vertical plane 50 extends through each of the proximate end member 16, the distal end member 18, the top member 20 and the bottom member 22, as is shown in FIG. 1. By having the connection member curved, as shown in FIG. 1, the utility head is positioned such that it is angled towards the user during use. This may make it easier for the user to use the personal care implement as an eating utensil. Alternatively, the connection member 24 may be straight, as is shown in FIG. 4 such that the utility head is in the vertical plane 50 of the handle section 12, where the vertical plane 50 extends through each of the proximate end member 16, the distal end member 18, the top member 20 and the bottom member 22, as is shown in FIG. 5. It is also noted that the connection member 24 may be curved, but with the utility head being in the vertical plane 50 of the handle section 12, where the vertical plane 50 extends through each of the proximate end member 16, the distal end member 18, the top member 20 and the bottom member 22, as is shown in FIG. 5.

The implement of the present invention may be made such that the handle section 12 and the utility head section 14 are a single unitary piece of material or the sections may be prepared separately and joined together using known means depending on the material used to make the implement. The implement of the present invention may be prepared from any durable material, and the actual selection of the material will generally be dictated by the end use of the implement. Exemplary materials include, for example plastic and metal and the like.

While the invention has been described above with references to specific embodiments thereof, it is apparent that many changes, modifications and variations can be made without departing from the invention concept disclosed herein. Accordingly, it is intended to embrace all such changes, modifications, and variations that fall within the spirit and broad scope of the appended claims.

What is claimed is:

1. An implement for use by an user having a hand, said implement comprising (i) a handle section, the handle section comprising a proximate end member, a distal end member, an upper member and a lower member, wherein the proximate end member is connected to the distal end member by the upper member and the lower member, such that the upper member, the lower member, the distal end member and the proximate end member form an aperture, said aperture being adapted to receive the hand of a user;

(ii) a utility head section connected to the handle section at the proximate end member, on a side of the proximate end member which is opposite said aperture of the handle section; and (iii) at least one projection member located on the proximate end member on a side of the proximate end member which faces away from and is directly opposite said aperture of the handle section.

2. The implement according to claim 1, comprising two projection members, wherein one projection member is located below where the utility head section connects to the proximate end member of the handle section, and a second projection member is located above where the utility head section connects to the proximate end member of the handle section.

3. The implement according to claim 1, wherein the utility head section comprises a utility head, wherein the utility head is a personal care implement.

4. The implement according to claim 3, wherein the personal care implement is spoon, a fork, a spork, a knife, a toothbrush, a hair brush or a comb.

5. The implement according to claim 4, wherein the personal care implement comprises a spoon.

6. The implement according to claim 1, wherein the handle section and the utility head section form a unitary structure.

7. The implement according to claim 1, wherein the utility head section is connected to the handle such that a utility head of the utility head section is out of a vertical plane of the handle section, where the vertical plane extends through each of the proximate end member, the distal end member, the top member and the bottom member.

8. The implement according to claim 1, wherein the top member and the bottom member are parallel to one another.

9. The implement according to claim 1, wherein the proximate end member and the distal end member are each curved.

10. The implement according to claim 9, wherein the proximate end member and the distal end member each have a C-shape.

11. The implement according to claim 1, wherein the handle section and utility head section are each prepared from metal or plastic.

12. The implement according to claim 11, wherein the utility head section has a utility head which is a spoon.

13. The implement according to claim 1, wherein the utility head section comprises a utility head and a connection member, the connection member having a first end and a second end, the first end being connected to an outer surface of the proximate end member, wherein the outer surface is on a side of the proximate end member which is opposite the aperture; and the second end is connected to the utility head.

14. The implement according to claim 13, wherein the connection member is straight.

15. The implement according to claim 13, wherein the connection member is curved.

16. The implement according to claim 1, comprising two projection members, wherein one projection member is located below where the utility head section connects to the proximate end member of the handle section, and a second projection member is located above where the utility head section connects to the proximate end member of the handle section; the top member and the bottom member are parallel to one another; and the proximate end member and the distal end member are each curved.

17. The implement according to claim 16, wherein the utility head section comprises a utility head, wherein the utility head is a personal care implement.

18. The implement according to claim 17, wherein the personal care implement is spoon, a fork, a spork, a knife, a toothbrush, a hair brush or a comb.

19. The implement according to claim 16, wherein the handle section and the utility head section form a unitary structure.

* * * * *